United States Patent [19]

Minoru et al.

[11] Patent Number: 4,911,989

[45] Date of Patent: Mar. 27, 1990

[54] SURFACE-COATED CEMENTED CARBIDE AND A PROCESS FOR THE PRODUCTION OF THE SAME

[75] Inventors: Nakano Minoru; Tobioka Masaaki; Nomura Toshio, all of Hyogo, Japan

[73] Assignee: Sumitomo Electric Industries, Ltd., Osaka, Japan

[21] Appl. No.: 335,811

[22] Filed: Apr. 10, 1989

[30] Foreign Application Priority Data

Apr. 12, 1988 [JP] Japan ..... 63-91183
Oct. 31, 1988 [JP] Japan ..... 63-277160
Oct. 31, 1988 [JP] Japan ..... 63-277161

[51] Int. Cl.[4] ..... B22F 3/00

[52] U.S. Cl. ..... 428/547; 428/552; 428/610; 428/908.8; 419/13; 419/14; 419/17; 419/18; 419/19; 419/25; 419/45; 419/57; 419/58; 419/59; 419/60

[58] Field of Search ..... 428/547, 410, 552, 908.8; 419/13, 14, 17, 18, 19, 25, 45, 57, 58, 59, 60

[56] References Cited

U.S. PATENT DOCUMENTS

Re. 32,111 4/1986 Lambert et al. ..... 428/547
3,999,953 12/1976 Kolaska et al. ..... 148/126
3,999,954 12/1976 Kolaska et al. ..... 148/126
4,610,931 9/1986 Nemith et al. ..... 428/547
4,830,930 5/1989 Taniguchi et al. ..... 428/547

*Primary Examiner*—Stephen J. Lechert, Jr.
*Attorney, Agent, or Firm*—Wenderoth, Lind & Ponack

[57] ABSTRACT

A coated cemented carbide alloy having jointly a high toughness and high wear resistance is produced by specifying the cooling rate during sintering in efficient manner, which alloy comprises a cemented carbide substrate consisting of a hard phase of at least one member selected from the group consisting of carbides, nitrides and carbonitrides of Group IVa, Va and VIa metals of Periodic Table and a binder phase consisting of at least one member selected from the iron group metals, and a monolayer or multilayer, provided thereon, consisting of at least one member selected from the group consisting of carbides, nitrides, oxides and borides of Group IVa, Va and VIa metals of Periodic Table, solid solutions thereof and aluminum oxide, in which the hardness of the cemented carbide substrate in the range of 2 to 5 μm from the interface between the coating layer and substrate is 800 to 1300 kg/mm$^2$ by Vickers hardness at a load of 500 g, is monotonously increased toward the interior of the substrate and becomes constant in the range of about 50 to 100 μm from the interface.

25 Claims, 1 Drawing Sheet

SURFACE-COATED CEMENTED CARBIDE AND A PROCESS FOR THE PRODUCTION OF THE SAME

BACKGROUND OF THE INVENTION

1. Field of the Invention

This invention relates to a coated cemented carbide having a very high toughness, used for cutting tools, etc. and more particularly, it is concerned with a high efficiency cutting tool consisting of a cemented carbide substrate coated with a vapor deposited thin film such as of titanium carbide, having jointly a high toughness of the substrate and high wear resistance of the surface coating.

2. Description of the Prior Art

Recently, N/C machines have been introduced into the field of cutting processing to markedly advance the so-called factory automation. In such a case, the reliability of cutting tools is very important and it is thus required to develop a cutting tool having a higher toughness than those of the prior art.

In order to satisfy this requirement, there have been proposed cemented carbide alloys in which only the surface layer consists of WC-Co (Japanese Patent Laid-Open Publication Nos. 159299/1977 and 194239/1982), methods comprising enriching the surface of an alloy with Co (Japanese Patent Laid-Open Publication Nos. 105628/1987, 187678/1985 and 194239/1982, i.e. U.S. Pat. No. 4,610,931) and a method comprising allowing free carbon to exist in an alloy so as to prevent formation of a decarburized layer just under a coating layer (Japanese Patent Laid-Open Publication No. 155190/1977).

However, the cemented carbide alloy having a WC-Co layer on only the surface or having a Co-enriched layer on the surface can exhibit improved toughness, but meets with a problem on wear resistance. At a higher cutting speed, in particular, the alloy having a Co-enriched layer cannot sometimes be put to practical use because of the higher wearing speed of a rake face. In the case of the alloy containing free carbon (FC), the toughness is improved with the increase of the amount of carbon, but if it exceeds 0.2% by weight, the alloy becomes agglomerative to lower the strength itself of the alloy.

SUMMARY OF THE INVENTION

It is an object of the present invention to provide a novel coated cemented carbide whereby the above described disadvantages of the prior art can be overcome.

It is another object of the present invention to provide a coated cemented carbide alloy having jointly a high toughness and high wear resistance.

It is a further object of the present invention to provide a high efficiency cutting tool consisting of a cemented carbide substrate coated with a hard thin film such as of titanium carbide.

It is a still further object of the present invention to provide a process for the production of the coated cemented carbide.

These objects can be attained by a surface coated cemented carbide comprising a cemented carbide substrate consisting of a hard phase of at least one member selected from the group consisting of carbides, nitrides and carbonitrides of Group IVa, Va and VIa metals of Periodic Table and a binder phase consisting of at least one member selected from the iron group metals, and a monolayer or multilayer, provided thereon, consisting of at least one member selected from the group consisting of carbides, nitrides, oxides and borides of Group IV, Va and VIa metals of Periodic Table, solid solutions thereof and aluminum oxide, in which the hardness of the cemented carbide substrate in the range of 2 to 5 μm from the interface between the coating layer and substrate is 800 to 1300 kg/mm$^2$ by Vickers hardness at a load of 500 g, is monotonously increased toward the interior of the substrate and becomes constant in the range of about 50 to 100 μm from the interface.

BRIEF DESCRIPTION OF THE INVENTION

The accompanying drawings are to illustrate the principle and merits of the invention in greater detail.

DETAILED DESCRIPTION OF THE INVENTION

Figure 1:
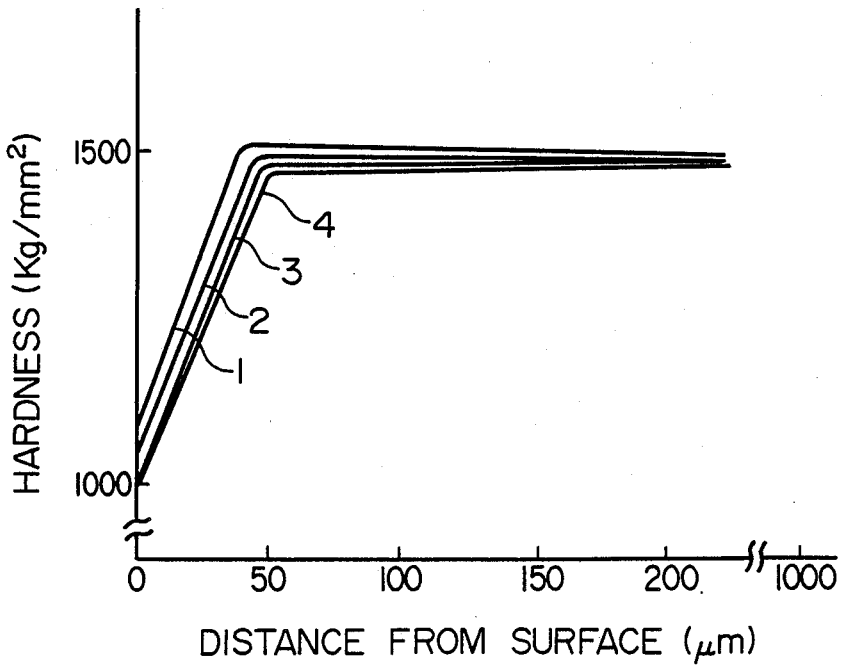
FIG. 1 is a graph showing the surface hardness distributions of Alloy Sample Nos. 1 to 4 according to preferred embodiments of the present invention.

We, the inventors, have made various efforts to develop a surface coated cemented carbide article for cutting tools, having most excellent properties, i.e. higher toughness than the prior art alloys while holding excellent wear resistance by the coating layer, and consequently have found that the following requirements should preferably be satisfied to this end.

(I) Using a cemented carbide, as a substrate, consisting of a hard phase of at least one member selected from the group consisting of carbides, nitrides and carbonitrides of Group IVa, Va and VIa metals of Periodic Table and a binder phase consisting of at least one member selected from the iron group metals, preferably WC and Co, or mixed carbides or mixed carbonitrides of W, Ti and Nb and/or Ta, and Co, more preferably 10 to 96% by weight of WC, 1 to 70% by weight of a mixed carbonitride of Ti, W, Ta and/or Nb, and 3 to 20% by weight of Co.

(II) The vicinity of the surface of the cemented carbide substrate consists of a layer consisting predominantly of WC and Co and having a thickness of 5 to 10 μm, the quantity of the binder phase in the cemented carbide substrate in the range of 2–20 μm, preferably 2–5 μm to 50–100 μm from the interface is 1.5 to 7 times by weight as much as the average quantity of the binder phase and in particular, the quantity of the binder phase Co in the cemented carbide substrate in the range of 2 to 20 μm, preferably 2 to 10 μm just under the interface is 1.5 to 7 times by weight as much as that in the range of about 50 to 100 μm. The quantity of the binder phase in the range of up to 5 μm from the interface is less than in the interior of the cemented carbide substrate and more preferably, the content of Co in the cemented carbide substrate in the range of up to 3 μm from the interface is less than that in the range of lower than 3 μm from the interface.

(III) The hardness of the layer consisting predominantly of WC and Co near the surface of the cemented carbide substrate, in particular, in the range of 2 to 5 μm from the interface is 700 to 1300 kg/mm$^2$, preferably 800 to 1300 kg/mm$^2$, more preferably 950 to 1250 kg/mm$^2$, most preferably 1000 to 1200 kg/mm$^2$, by Vickers hardness at a load of 500 g. The hardness of the substrate is monotonously increased toward the interior thereof and becomes constant in the range of about 50 to 100 μm from the interface, preferably 1500 to 1700 kg/mm$^2$ by Vickers hardness at a load of 500 g.

(IV) When the binder phase is of Co, the quantity of free carbon [FC] in the cemented carbide is 1 to 2.4% by weight based on that of Co, and when the binder phase is of Ni, the quantity of [FC] is 0.5 to 2.2% by weight based on that of Ni.

(V) The quantities of free carbon [FC] and nitrogen [N] in the cemented carbide substrate have the following relationship:

$$0.06 \leqq [FC] + (12/14) \times [N] \leqq 0.17$$

wherein [FC] and [N] are represented by weight %.

The coated cemented carbide of the present invention, having the above described structures and features, can be prepared by sintering the starting materials described in (I), including a step of cooling at a cooling rate of 0.1° to 10° C./min., preferably cooling at a cooling rate of 0.1° to 10° C. within a temperature range of from 1310° C. to 1225° C. or preferably carrying out the cooling within a temperature range of 1310° C. to 1225° C. in a period of time of 10 minutes to 15 hours, and then coating the resulting substrate with a monolayer or multilayer consisting of at least one member selected from the group consisting of carbides, nitrides, oxides and borides of Group IVa, Va and VIa elements of Periodic Table, solid solutions thereof and aluminum oxide.

Preferably, the cemented carbide substrate obtained by the above described sintering step can further be subjected to a chemical, mechanical or electrochemical processing to remove the Co or Co and C from the surface part of the cemented carbide substrate.

The features and structures of the surface-coated cemented carbide of the present invention and a process for producing the same will now be illustrated in detail:

Since the cemented carbide substrate of the present invention contains a hard phase of at least one member selected from the group consisting of carbides, nitrides and carbonitrides of Group IVa, Va and VIa metals, this nitrogen-containing hard phase is subjected to denitrification and decomposition in a part of the sintering step to thus form a layer consisting of predominantly WC and Co, for example, when the hard phase is of WC. "Predominantly" means that ordinarily, the nitrogen-containing hard phase is not completely decomposed to retain a small amount of nitrogen.

In such a case, [FC] and [N] in the cemented carbide alloy should preferably satisfy the following relationship:

$$0.06 \leqq [FC] + (12/14) \times [N] \leqq 0.17$$

wherein [FC] and [N] are represented by % by weight. When the analytical amounts of [FC] and [N] in the alloy are respectively 0.1% and 0.03%, for example, $0.1 + 12/14 \times 0.03 = 0.12$. In this formula, [FC] represents the amount of free carbon in the binder phase and [N] represents that of nigrogen in the cemented carbide alloy. When a cemented carbide is prepared by sintering, Co and C form a Co-C melt through eutectic reaction at an eutectic temperature of about 1309° C. In an actual cemented carbide alloy, however, C and W are dissolved in Co to form a Co-W-C melt through eutectic reaction. The eutectic temperature in this case is supposed to be 1255° C. The present invention is characterized by the use of this Co-W-C melt and the effective use of the melt can be carried out in the above described range (hereinafter referred to as carbon equivalent). On the other hand, nitrogen is supposed to show a similar behavior to carbon.

The cemented carbide alloy having the above described composition is cooled at a cooling rate of 0.1° to 10° C./min, preferably 1° to 5° C./min within a range of from 1310° C. to 1225° C., preferably from 1310° C. to 1255° C. 1225° C. is the eutectic temperature at which Co, and C and η phase coexist (η phase means a compound of Co, W and C) probably due to that the carbon content in the alloy surface is markedly decreased. The cooling of the cemented carbide can be carried out in such a manner that it is maintained within a temperature range of 1310° C. to 1225° C. for 10 minutes to 15 hours.

When the binder phase is of Co or Ni, the quantity of [FC] in the alloy should preferably be in such a range that a liquid phase of Co-C eutectic composition or Ni-C eutectic composition appears, so as to attain the object of the present invention. That is, the quantity of [FC] is 1 to 2.4% by weight based on Co in the case of a Co binder phase and 0.5 to 2.2% by weight based on Ni in the case of a Ni binder phase. If it is more than the upper limit, a compound of Co or Ni and C is precipitated as a primary crystal, which should be avoided, while it is less than the lower limit, liquid phase of the eutectic composition does not appear. In this case, the object of the present invention cannot be attained.

The hard phase containing a nitride as described in (I) is subjected to denitrification reaction to reduce the carbon equivalent on the alloy surface and accordingly, the Co-W-C melt in the interior of the alloy is removed to the surface thereof. That is, a concentration gradient of the Co-W-C melt occurs on the alloy surface through diffusion of the Co-W-C melt, which will cause a monotonous increase of alloy strength after sintering. Since the alloy surface, in particular, consists predominantly of WC-Co, in general, WC-(4.5–60 wt%)Co, the hardness is largely lowered to a Vickers hardness of 700 to 1000 kg/mm$^2$ at a load of 500 g. If the carbon equivalent described in the foregoing (V) is less than 0.06, the Co-W-C melt diffusion is too little to achieve the structure of the present invention, while if the carbon equivalent is more that 0.17, a compound of Co and C is precipitated as columnar crystals in the alloy surface to render brittle. If the temperature exceeds the above described range, i.e. 1310° C., the movement speed of the Co-W-C melt is so large that it is carried away on the alloy surface and the monotonous change of hardness cannot be given, while if lower than 1225° C., the Co-W-C melt is not formed so that the above described hardness change cannot be given. If the cooling rate exceeds 10° C./min, movement of the Co-W-C melt is too little to give the hardness change, while if smaller than 0.1° C./min, the productivity on commercial scale is lowered, which should be avoided. Preferably, the cooling rate is in the range of 1° to 5° C./min.

In the process of sintering the alloy, the denitrification reaction in the alloy should preferably be suppressed, for example, by introducing $N_2$, $CH_4$, $H_2$, Ar gases, etc, until reaching 1310° C. Within a range of 1310° to 1225° C., the sintering should preferably be effected in high vacuum, or decarburizing or oxidizing atmosphere, for example, $H_2$, $H_2+H_2O$, $CO_2$, $CO_2+CO$, etc.

The alloy surface layer consisting predominantly of WC and Co is formed through decomposition of the nitride-containing hard phase, but it can also be formed by nitriding Group IVa, Va or VIa metal during raising the temperature and then subjecting to denitrification decomposition.

In the present invention, the hardness of the alloy surface is generally in the range of 700 to 1000 kg/mm$^2$, since if less than 700 kg/mm$^2$, the toughness is remarkably improved, but the wear resistance is lowered so that a problem arises on practical use, while if more than 1000 kg/mm$^2$, further improvement of the toughness cannot be expected. The surface hardness can be controlled by the cooling rate and the extent of denitrification or decarburization of the alloy surface. In order to hold both the wear resistance and toughness satisfactory, that is, from the standpoint of using widely the alloy for various purposes, it is preferable to adjust the hardness of the surface layer in the range of 2 to 5 μm from the interlayer to 700 to 1300 kg/mm$^2$, preferably 950 to 1250 kg/mm$^2$, more preferably 1000 to 1200 kg/mm$^2$ and that of the interior in the range of about 50 to 100 μm from the alloy surface to 1500 to 1700 kg/mm$^2$. Outside this range, problems often arise as to the wide use. The hardness is a Vickers hardness at a load of 500 g and as in general ceramics, it depends on the load weight of course, the hardness of the surface layer showing a somewhat higher value at a load of more than 500 g.

When the cemented carbide substrate of the present invention is sintered by the above described process, the quantity of the binder phase in the alloy in the range of 2–20 μm to 50–100 μm from the interface between the alloy surface and coating layer is 7 to 1.5 times by weight as much as the average quantity of the binder phase. In particular, the quantity of the binder phase in the range of up to 50 μm from the alloy surface exceeds 3 times, which is much larger than that of the prior art as disclosed in Japanese Patent Laid-Open Publication No. 199239/1982. According to the present invention, the binder phase in the alloy surface is largely enriched.

In the present invention, there is Co or Co and C in the alloy surface. Thus, there arises such a problem in practical cutting even using the surface-coated cemented carbide alloy as a cutting tool that the cutting tool meets with somewhat larger crater depth at a higher cutting speed. In this case, the problem can be solved by rendering less the binder phase in the range of up to 5 μm, preferably 1 to 5 μm from the interface of the coating layer and alloy surface than the average quantity of the binder phase in the alloy, or by eliminating it, since if the range exceeds 5 μm, the toughness is largely lowered. In the case of eliminating the binder phase, the range should preferably be at most 3 μm, since if exceeding 3 μm, the toughness is largely lowered. The reduction or elimination of the binder phase can be carried out by chemical treatments, for example, with acids such as nitric acid, hydrochloric acid, hydrofluoric acid, sulfuric acid and the like, mechanical treatments such as barrel treatment, brushing and the like or electrochemical treatments.

The coating layer used in the present invention is generally formed by coating a monolayer or multilayer consisting of at least one member selected from the group consisting of carbides, nitrides, oxides and borides of Group IVa, Va and VIa elements of Periodic Table, solid solutions thereof and aluminum oxides and having a thickness of 1 to 20 μm by CVD method.

The coated cemented carbide of the present invention has a higher toughness than the alloys of the prior art with an excellent wear resistance by the coating layer and can thus provide a more reliable tool as compared with the tools of the prior art.

The following examples are given in order to illustrate the present invention in detail without limiting the same, in which percents are to be taken as those by weight unless otherwise indicated.

EXAMPLE 1

2.5% of Ti(CN), 3.0% of TaC, 6.0% of Co and the balance of WC were mixed to give [FC]+12/14×[N] in the alloy (carbon equivalent) as shown in Table 1, heated in vacuum to 1400° C., held for 30 minutes in an $N_2$ atmosphere at 2 torr, then cooled, to 1310° C. at a cooling rate of 10° C./min and cooled to 1200° C. in vacuum ($10^{-3}$ torr) at a cooling rate of 3° C./min. The resulting cemented carbide alloy was coated with an inner layer of 5 μm TiC and outer layer of 1 μm $Al_2O_3$ by an ordinary CVD method and then subjected to a cutting test under the following conditions (Type: CNMG 120408; Holder Type: PCLNR 2525-43).

For comparison, a commercially available coated insert with 5 μm TiC and 1 μm $Al_2O_3$ of M 20 grade was subjected to the similar test.

The test results and the Hv hardness of the substrate at a load of 500 g in the range of 5 μm from the interlayer are shown in Table 1.

Cutting Conditions A (Wear Resistance Test)

Cutting Speed: 180 m/min
Feed: 0.36 mm/rev
Depth of Cut: 2.0 mm
Workpiece: SCM 435
Cutting Time: 20 minutes Cutting Conditions B (Toughness Test)

Cutting Speed: 60 m/min
Feed: 0.20–0.40 mm/rev
Depth of Cut: 2.0 mm
Workpiece: SCM 435 (10 mm×50 mm grooved)
Cutting Time: 30 seconds repeated 8 times

TABLE 1

| Sample No. | [FC] + (12/14) × [N] | Surface Hardness (kg/mm$^2$) | Test A Flank Wear Width | Test B Breakage |
|---|---|---|---|---|
| 1 | 0.06 | 1200 | 0.22 mm | 20% |
| 2 | 0.10 | 1100 | 0.21 mm | 10% |
| 3 | 0.12 | 1050 | 0.22 mm | 5% |
| 4 | 0.15 | 1000 | 0.23 mm | 0% |
| Comparative Sample | 0 | 1300 | 0.27 mm | 100% (broken) |

It was found by observation of the cross-sectional structure of the alloy surface as to Samples 1 to 4 that in the range of about 5 μm from the surface, only WC-Co layer is formed, inside the range of 5 μm, there was a mixed carbonitride of (Ti, Ta, W) (CN) and in the interior of the alloy, FC precipitated. In FIG. 1, the hardness distributions in the surface layer of Sample Nos. 1 to 4 are shown. Inside the range of 100 μm beneath the alloy surface, the hardness was 1500 kg/mm$^2$.

In the following Examples 2, alloys were used in which in the range of up to 0.5 μm, Co or Co and C had been removed by immersing in a 10% nitric acid solution at 20° C. for 10 minutes.

EXAMPLE 2

For sintering Sample No. 3 of Example 1, WC powders with a grain size of 4 μm and 2 μm were used in a proportion of 1:1 and 1:2, followed by sintering, coating and subjecting to tests in an analogous manner to Example 1.

Consequently, in Test A, the former showed a flank wear width of 0.18 mm and the latter, 0.15 mm, and in Test B, the former showed a breakage ratio of 8% and the latter, 12%. The hardness of the alloy surface was 1070 kg/mm$^2$ in the case of the former and 1120 kg/mm$^2$ in the case of the latter, while that in the range of 100 μm from the alloy surface was 1600 kg/mm$^2$ in the case of the former and 1680 kg/mm$^2$ in the case of the latter.

EXAMPLE 3

The sintered body of Sample No. 4 of Example 1 was immersed (i) in a 10% aqueous solution of nitric acid for 10 minutes, (ii) in the same solution for 25 minutes and (iii) in a 20% aqueous solution of nitric acid for 10 minutes, the temperature being in common 20° C., to remove Co and C of the alloy surface, respectively corresponding to Sample Nos. 5 to 7.

These alloys were then subjected to coating and Test A and B in an analogous manner to Example 1, thus obtaining results as shown in Table 2:

TABLE 2

| Sample No. | [FC] + (12/14) × [N] | Test A Flank Wear Width | Test B Breakage |
|---|---|---|---|
| 5 | 0.15 | 0.18 mm | 3% |
| 6 | 0.15 | 0.15 mm | 8% |
| 7 | 0.15 | 0.12 mm | 10% |

The quantity of Co was less in the range of up to 2 μm from the surface than that of interior in the case of Sample No. 5, and Co was eliminated in the ranges of up to 5 μm and 3 μm from the surface, respectively in the case of Sample Nos. 6 and 7.

EXAMPLE 4

An alloy consisting of 2.0% of Ti(CN), 3.0% of TaC, 5.6% of Co and the balance of WC and having a carbon equivalent of 0.15 was sintered and cooled to 1310° C. in an analogous manner to Example 1 and then cooled to 1200° C. under conditions as shown in Table 3:

TABLE 3

| Sample No. | [FC] + (12/14) × [N] | Cooling Rate (°C./min) | Atmosphere | Surface Hardness (kg/mm$^2$) |
|---|---|---|---|---|
| 8 | 0.06 | 1 | vacuum, $10^{-3}$ torr | 1200 |
| 9 | 0.10 | 1 | vacuum $10^{-3}$ torr | 1120 |
| 10 | 0.12 | 1 | vacuum $10^{-3}$ torr | 1080 |
| 11 | 0.15 | 1 | vacuum $10^{-3}$ torr | 900 |

Figure 2:
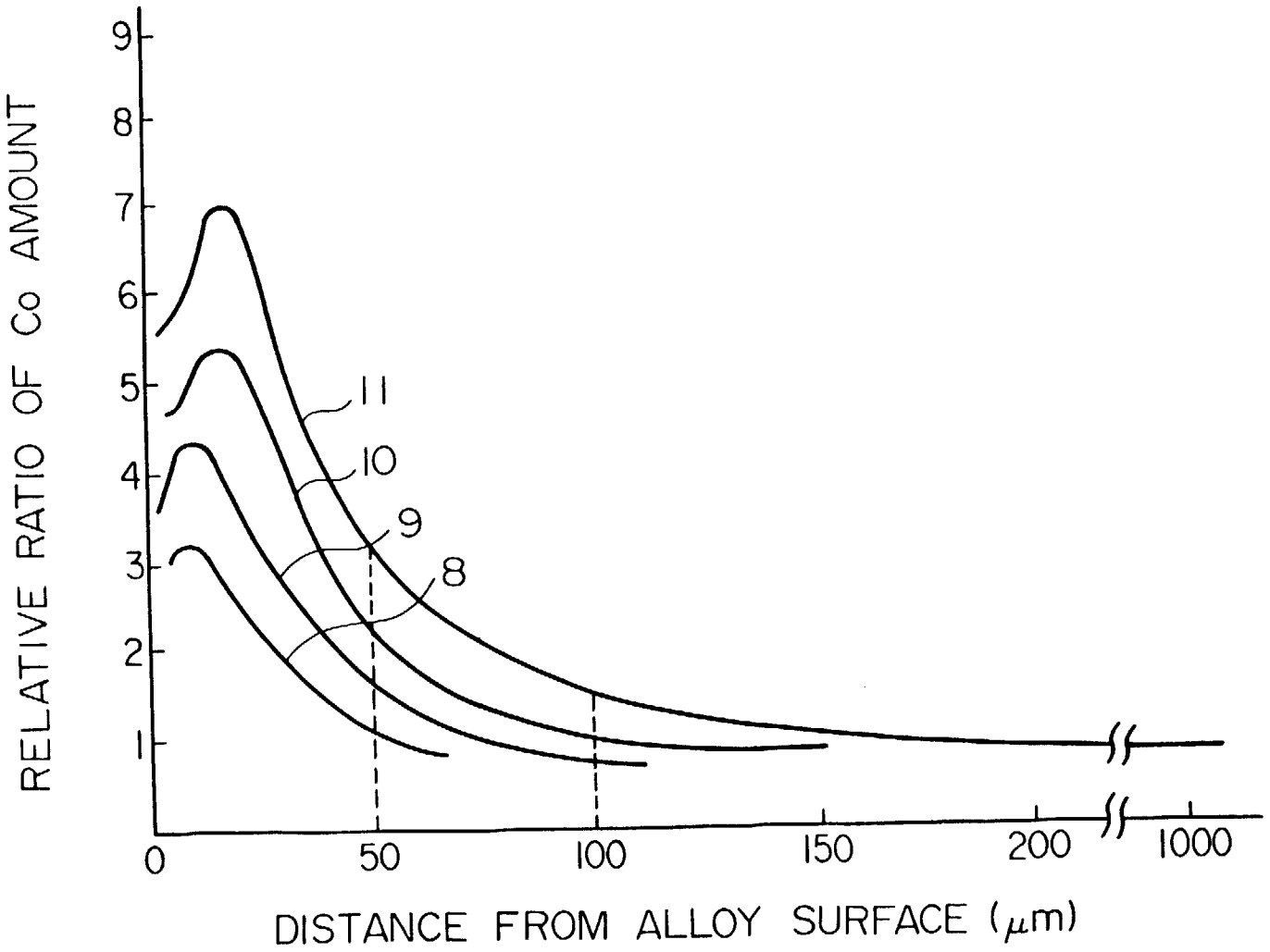
FIG. 2 is a graph showing the Co distributions in the surfaces of Alloy Sample Nos. 8 to 11 according to preferred embodiments of the present invention.

The quantity of Co enrichment in the vicinity of the alloy surface was analyzed by EPMA (ACC: 20 KV, SC: 200 A, beam diameter: 10 μm) to obtain results as shown in FIG. 2.

EXAMPLE 5

An alloy consisting of 2.5% of Ti(CN), 6.0% of TaC, 5.6% of Co and the balance of WC and having a carbon equivalent of 0.15 was heated in vacuum to 1400° C., cooled to 1310° C. at a cooling rate of 2° C./min in an atmosphere of $CH_4$ and $H_2$ and then cooled to 1200° C. at 0.5° C./min in vacuum ($10^{-5}$ torr) or $CO_2$ atmosphere. The resulting alloy had a surface hardness of 920 kg/mm$^2$, the hardness being monotonously increased in the range of up to 70 μm beneath the surface to a constant value, 1600 kg/mm$^2$. In the range of 5 μm from the surface, a mixed carbonitride of (Ti, Ta, W)(CN) was decreased as compared with the interior of the alloy.

This alloy was coated with layers of 3 μm TiC, 2 μm TiN, 1 μm TiCN and 1 μm $Al_2O_3$ and then subjected to cutting tests in the similar manner to Example 1, thus obtaining a flank wear width of 0.23 mm and breakage of 3%.

EXAMPLE 6

An alloy consisting of 2.0% of Ti(CN), 6.0% of TaC, 5.6% of Co and the balance of WC and having a carbon equivalent of 0.15 was sintered and cooled to 1310° C. in an analogous manner to Example 1 and then cooled to 1200° C. under conditions as shown in Table 4:

TABLE 4

| Sample No. | Colling Rate (°C./min) | Atmosphere | Surface Hardness (Hv) (kg/mm$^2$) |
|---|---|---|---|
| 12 | 10 | vacuum, $10^{-5}$ torr | 1200 |
| 13 | 5 | vacuum, $10^{-5}$ torr | 1100 |
| 14 | 2 | vacuum, $10^{-5}$ torr | 1000 |
| 15 | 1 | vacuum, $10^{-5}$ torr | 950 |
| 16 | 0.1 | vacuum, $10^{-5}$ torr | 850 |
| 17 | 2 | $CO_2$, 0.5 torr | 950 |
| 18 | 2 | ($CO_2$ + CO), 2 torr | 890 |

EXAMPLE 7

The alloy of Sample No. 16 of Example 6 was immersed in a 1.0% aqueous solution of nitric acid for 10 minutes, then neutralized with a 5% aqueous solution of sodium hydroxide for 5 minutes, washed with water for 5 minutes, sprayed with diamond grains of No. 1000 and polished by a steel brush. The thus treated alloy was coated with layers of 5 μm TiC and 1 μm $Al_2O_3$ and subjected to cutting tests in an analogous manner to Example 1. The acid treatment-free sample showed initial peeling, while the acid-treated sample showed a normal worn state.

EXAMPLE 8

An alloy powder consisting of 2.0% TiC, 6.0% of TaC, 5.6% of Co and the balance of WC was formed in Form No. SNG 432, heated to 1000° C. in vacuum, sintered at from 1000° C. to 1450° C. in an $N_2$ atmosphere to give an alloy carbon equivalent of 0.15, and then cooled in an analogous manner to Example 5, thus obtaining an alloy having a substantially similar structure and hardness distribution to that of Example 5.

EXAMPLE 9

An alloy powder consisting of 2.0% of Ti(CN), 5.0% of TaC, 5.6% of Co and the balance of WC was formed in Form No. SNG 432, heated in vacuum and sintered at 1400° C. in vacuum to give a carbon equivalent of 0.15. The thus resulting alloy was worked in a predetermined shape, subjected to an edge-forming treatment, heated to 1350° C., held in an $N_2$ atmosphere at 5 torr for 30 minutes, rapidly cooled at 20° C./min to 1310° C.

and then further cooled from 1310° C. to 1200° C. at 2° C./min in vacuum of $10^{-5}$.

The resulting alloy had a WC-Co layer in the range of up to 2 μm from the alloy surface and a surface hardness of 1020 kg/mm². Similarly, when the sintering was carried out in an atmosphere of $CO_2$ of 0.5 torr, the surface hardness was 990 kg/mm².

EXAMPLE 10

The similar composition to that of Example 1 was blended in such a manner that the quantity of free carbon be 1, 1.5, 2 and 2.4% based on that of Co. When the resulting alloys were subjected to a test under Cutting Conditions B, the breakage ratios were respectively 23%, 8%, 2% and 0%.

EXAMPLE 11

The alloy of Sample No. 4 of Example 1 was immersed in a 20% aqueous solution of nitric acid at 20° C. for 20 minutes, 10 minutes and 5 minutes. In the sample treated for 20 minutes, the Co phase disappeared in the range of 5 μm from the surface, in the sample treated for 10 minutes, the Co phase disappeared in the range of 3 μm from the surface and in the sample treated for 5 minutes, the Co phase disappeared in the range of 1 μm from the surface.

These alloys were subjected to tests under Cutting Conditions A and B to obtain results as shown in Table 5:

TABLE 5

| Treatment Time (min) | Test A | Test B |
|---|---|---|
| 20 | 0.08 mm | 20% |
| 10 | 0.12 mm | 10% |
| 5 | 0.18 mm | 2% |

EXAMPLE 12

An alloy powder consisting of 2.0% of TiC, 6.0% of TaC, 5.6% of Co and the balance of WC was formed in Form No. SNG 432, sintered in vacuum at 1450° C. and then cooled in an analogous manner to Example 5, thus obtaining an alloy having a substantially similar structure and hardness distribution to that of Example 5.

What is claimed is:

1. A surface coated cemented carbide comprising a cemented carbide substrate consisting of a hard phase of at least one member selected from the group consisting of carbides, nitrides and carbonitrides of Group IVa, Va and VIa metals of Periodic Table and a binder phase consisting of at least one member selected from the iron group metals, and a monolayer or multilayer, provided thereon, consisting of at least one member selected from the group consisting of carbides, nitrides, oxides and borides of Group IVa, Va and VIa metals of Periodic Table, solid solutions thereof and aluminum oxide, in which the hardness of the cemented carbide substrate in the range of 2 to 5 μm from the interface between the coating layer and substrate is 700 to 1300 kg/mm² by Vickers hardness at a load of 500 g, is monotonously increased toward the interior of the substrate and becomes constant in the range of about 50 to 100 μm from the interface.

2. The surface coated cemented carbide as claimed in claim 1, wherein the hardness of the cemented carbide substrate in the range of 2 to 5 μm from the interface is 950 to 1250 kg/mm².

3. The surface coated cemented carbide as claimed in claim 1, wherein the hardness of the cemented carbide substrate in the range of about 50 to 100 μm from the interface is 1500 to 1700 kg/mm².

4. The surface coated cemented carbide as claimed in claim 1, wherein the vicinity of the surface of the cemented carbide substrate consists of a layer consisting predominantly of WC and Co and having a thickness of 5 to 10 μm.

5. The surface coated cemented carbide as claimed in claim 1, wherein the quantity of the binder phase in the cemented carbide substrate, in the range of 2–20 μm to 50–100 μm from the interface is 1.5 to 7 times by weight as much as the average quantity of the binder phase.

6. The surface coated cemented carbide as claimed in claim 1, wherein the quantity of the binder phase in the cemented carbide substrate in the range of 2 to 20 μm from the interface is 1.5 to 7 times by weight as much as that in the range of about 50 to 100 μm.

7. The surface coated cemented carbide as claimed in claim 1, wherein when the binder phase consists of Co, the quantity of free carbon is 1 to 2.4% by weight based on that of Co, and when the binder phase consists of Ni, the quantity of free carbon is 0.5 to 2.2% by weight based on that of Ni.

8. The surface coated cemented carbide as claimed in claim 1, wherein the quantities of free carbon [FC] and nitrogen [N] in the cemented carbide substrate have the following relationship:

$$0.06 \leqq [FC] + (12/14) \times [N] \leqq 0.17$$

wherein [FC] and [N] are represented by weight %.

9. The surface coated cemented carbide as claimed in claim 1, wherein the quantity of the binder phase in the range of up to 5 μm from the interface is less than in the interior of the cemented carbide substrate.

10. The surface coated cemented carbide as claimed in claim 1, wherein the content of the binder phase in the cemented carbide substrate in the range of up to 3 μm from the interface is less than that in the range of lower than 3 μm from the interface.

11. The surface coated cemented carbide as claimed in claim 1, wherein the cemented carbide substrate consists of 10 to 95% by weight of WC, 1 to 70% by weight of a mixed carbonitride of Ti, W and Ta, and/or Nb, and 3 to 20% by weight of Co.

12. The surface coated cemented carbide as claimed in claim 1, wherein Co or Co and C in the surface layer are removed by a chemical, mechanical or electrochemical treatment.

13. A process for the production of the surface coated cemented carbide as claimed in claim 1, which comprises mixing and sintering starting materials corresponding to the components for the hard phase and binder phase or being capable of in situ forming these components through decomposition or reaction, cooling the mixture at a cooling rate of 0.1° to 10° C./min and coating the resulting cemented carbide substrate with coating materials corresponding to the components for the monolayer or multilayer.

14. The process as claimed in claim 13, wherein the cooling is carried out at a cooling rate of 0.1° to 10° C./min within a temperature range of 1310° to 1225° C.

15. The process as claimed in claim 13, wherein the mixture to be cooled has contents of free carbon [FC] and nitrogen [N] satisfying the relationship of:

$$0.06 \leqq [FC] + (12/14) \times [N] \leqq 0.17$$

wherein [FC] and [N] are represented by weight %.

16. The process as claimed in claim 13, wherein the sintering is carried out while suppressing the denitrification reaction until cooling to 1310° C.

17. The process as claimed in claim 16, wherein the denitrification reaction is suppressed by introducing at least one member selected from the group consisting of $N_2$, $CH_4$, $H_2$ and Ar.

18. The process as claimed in claim 14, wherein the cooling from 1310° to 1225° C. is carried out in vacuum or in an oxidizing atmosphere.

19. The process as claimed in claim 13, wherein the cemented carbide substrate before coating is subjected to a chemical, mechanical or electrochemical treatment to remove Co or Co and C from the surface layer thereof.

20. A process for the production of the surface coated cemented carbide as claimed in claim 1, which comprises mixing and sintering starting materials corresponding to the components for the hard phase and binder phase or being capable of in situ forming these components through decomposition or reaction, cooling the mixture in a period of time of from 10 minutes to 15 hours within a temperature range of from 1310° C. to 1225° C.

21. The process as claimed in claim 20, wherein the mixture to be cooled has contents of free carbon [FC] and nitrogen [N] satisfying the relationship of:

$$0.06 \leqq [FC] + (12/14) \times [N] \leqq 0.17$$

wherein [FC] and [N] are represented by weight %.

22. The process as claimed in claim 20, wherein the sintering is carried out while suppressing the denitrification reaction until cooling to 1310° C.

23. The process as claimed in claim 22, wherein the denitrification reaction is suppressed by introducing at least one member selected from the group consisting of $N_2$, $CH_4$, $H_2$ and Ar.

24. The process as claimed in claim 14, wherein the cooling is carried out in vacuum or in an oxidizing atmosphere.

25. The process as claimed in claim 20, wherein the cemented carbide substrate before coating is subjected to a chemical, mechanical or electrochemical treatment to remove Co or Co and C from the surface layer thereof.

* * * * *

UNITED STATES PATENT AND TRADEMARK OFFICE

CERTIFICATE OF CORRECTION

PATENT NO. : 4,911,989

DATED : March 27, 1990

INVENTOR(S) : Minoru Nakano et al

It is certified that error appears in the above-indentified patent and that said Letters Patent is hereby corrected as shown below:

The drawing sheet, consisting of Fig. 2, should be added as shown on the attached page.

Signed and Sealed this

Twenty-sixth Day of October, 1993

*Attest:*

Bruce Lehman

BRUCE LEHMAN

*Attesting Officer*

*Commissioner of Patents and Trademarks*